US005160803A

United States Patent [19]

Fulchiron et al.

[11] Patent Number: 5,160,803

[45] Date of Patent: Nov. 3, 1992

[54] MUNITION FOR THE DISTRIBUTION OF AN INCENDIARY MIXTURE

[75] Inventors: Noël Fulchiron, Tigy; Bernard Naillon, Orleans; Patrick Nadaud, Olivet, all of France

[73] Assignee: Thomson-Brandt Armements, Boulogne Billancourt, France

[21] Appl. No.: 618,479

[22] Filed: Nov. 27, 1990

[51] Int. Cl.[5] ..... F42B 12/44; F42B 12/46

[52] U.S. Cl. ..... 102/363; 102/229; 102/254; 102/364

[58] Field of Search ..... 102/229, 254, 363, 364, 102/365, 396, 397, 477

[56] References Cited

U.S. PATENT DOCUMENTS

| | | | |
|---|---|---|---|
| 3,005,406 | 10/1961 | Ronfeldt | 102/363 |
| 3,296,967 | 1/1967 | Bounds et al. . | |
| 3,433,437 | 3/1969 | Bates . | |
| 3,636,874 | 1/1972 | Gey et al. . | |
| 3,712,217 | 1/1973 | Little et al. . | |
| 3,888,179 | 6/1975 | Nord et al. . | |
| 3,905,297 | 9/1975 | Barr et al. . | |
| 3,955,509 | 5/1976 | Carlson . | |
| 3,994,226 | 11/1976 | Rakowsky et al. | 102/363 |
| 4,132,169 | 1/1979 | Gay et al. | 102/363 |
| 4,141,294 | 2/1979 | Zaharia . | |
| 4,157,928 | 6/1979 | Falterman et al. | 102/363 |
| 4,493,262 | 1/1985 | Hutcheson | 102/363 |

OTHER PUBLICATIONS

Revue Internationale De Defense, vol. 20, No. 10, 1987, pp. 1405-1407. K. S. Brower.

*Primary Examiner*—Harold J. Tudor
*Attorney, Agent, or Firm*—Roland Plottel

[57] ABSTRACT

The invention concerns the domain of a charges which can be released, for example, from an aircraft to which they are fixed, and in particular a munition containing an incendiary gel made of hydrocarbons and gelatinizing agents, intended to have an incendiary effect on various targets on the ground.

The invention enables the munition to be broken up above the ground thanks to means of distribution constituted of a detonating cord, gas-generating grains, a shield and a rod. These means of distribution ensure regular scattering of the incendiary gel before the impact on the ground. The invention also enables ignition of the incendiary gel on break-up of the munition thanks to means of ignition composed of ignition capsules.

Application to munitions containing an incendiary gel, also to munitions containing a product to be scattered.

21 Claims, 3 Drawing Sheets

MUNITION FOR THE DISTRIBUTION OF AN INCENDIARY MIXTURE

BACKGROUND OF THE INVENTION

The invention concerns the domain of charges which can be released, for example, from an aircraft to which they are fixed, and in particular a munition containing an incendiary gel made of hydrocarbons and gelatinizing agents, intended to have an incendiary effect on various targets on the ground.

Munitions containing incendiary gels constituted of a mixture of volatile hydrocarbons (kerosene, gasoline, . . . ) and gelatinizing agents (fatty acid derivatives) enable these gels, after the impact on the ground, to be distributed and to adhere to various objectives on the ground. Since these munitions are generally not aerodynamically stable, their precision is poor. On impact with the ground, the distribution of the incendiary gel is random since the munition breaks up from the shock, thus provoking ejection of the incendiary gel in splashes. This impact also triggers an ignition fuze which generally ignites phosphorus whose projection, after the impact, ignites only some of the splashes of incendiary gel. The ballistic precision, the dispersion of the incendiary gel and the reliability of ignition of the gel are the major problems encountered with this type of munition.

SUMMARY OF THE INVENTION

The aim of the invention is to remedy these disadvantages and to create a munition in which an incendiary gel is distributed, before the impact on the ground, to ensure better dispersion of the said incendiary gel, the latter being ignited preferably by a means of ignition operating as soon as break-up occurs but also after the impact on the ground.

BRIEF DESCRIPTION OF THE DRAWINGS

The invention will be better understood on reading the following description, given as a non-restrictive example and illustrated by the drawings which represent.

DESCRIPTION OF THE PREFERRED EMBODIMENTS

Figure 1:
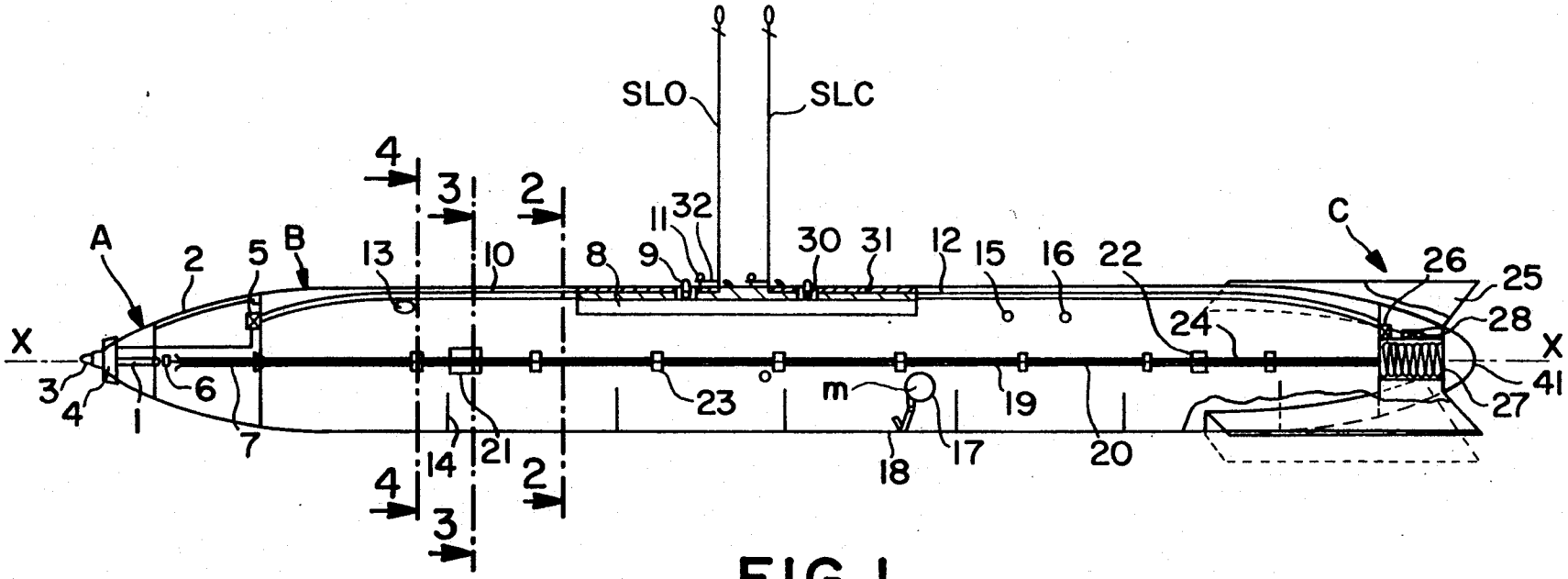
FIG. 1, a diagram of a munition equipped according to the invention.

FIG. 1 represents the diagram of the munition equipped according to the invention. This munition is composed of the following main parts:

- a nose cone A with a fuze and a proximity detector;
- a reservoir B in the strict sense of the term with its equipment;
- a tapered tail end C with a fixed tail-fin unit and a parachute.

Each of its parts comprises various elements which will be described below. The nose cone A, for example of a composite material so that no metal affects the proximity detector, comprises:

- A fuze 3 already used on other munitions, mounted on a support which is made to rotate by a propeller 4; this fuze 3 is constituted mainly of parts not represented on this figure:
  - a turbo-generator supplying the electrical energy;
  - a proximity module, for example, using electromagnetic radiation, enabling the break-up to be triggered at a given height above the ground;
  - an ignition pyrotechnic chain;
  - a barrel for disalignment of the chain;
  - a safety device preventing operation within a certain distance from the aircraft;
- A fuze holder 1 positioning the fuze 3 in such a way that the radiation from the antenna of the proximity module is not disturbed by the presence of the mass of metal;
- A fairing 2, for example, of a plastic material inside which is fixed a retracting device 5 of a nose cone releasable safety cable SLO which after release enables rotation of a propeller 4 and of the turbo-generator, and at the center of which is positioned, between one end of an ignition pyrotechnic tube 7 and the fuze holder 1, a shield 6 which ensures the interruption of the pyrotechnic chain.

Figure 2:
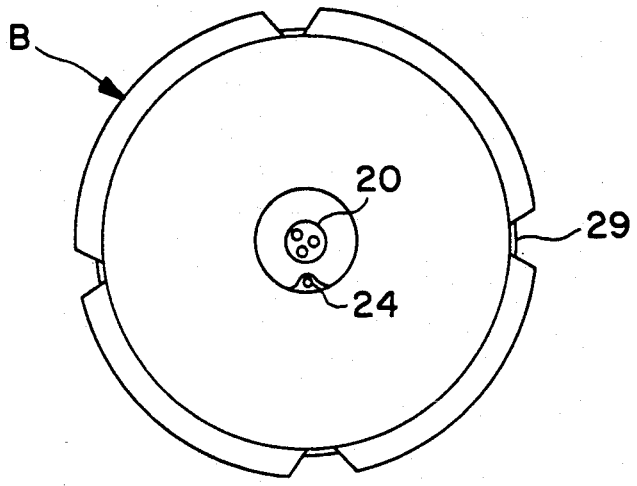
FIG. 2, a transverse section AA' of the munition represented in FIG. 1.
Figure 5:
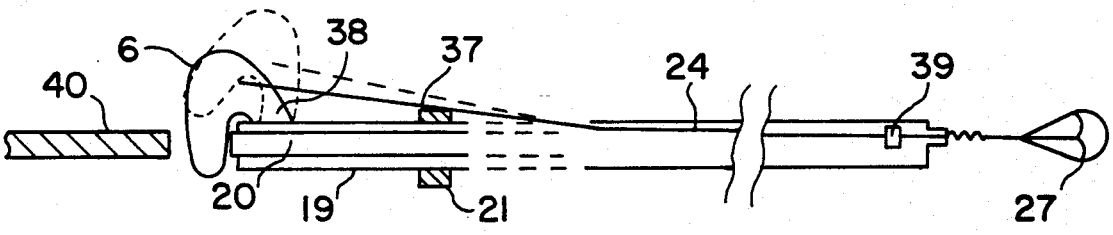
FIG. 5, a diagram of a pyrotechnic tube surrounded by these different parts.
Figure 3:
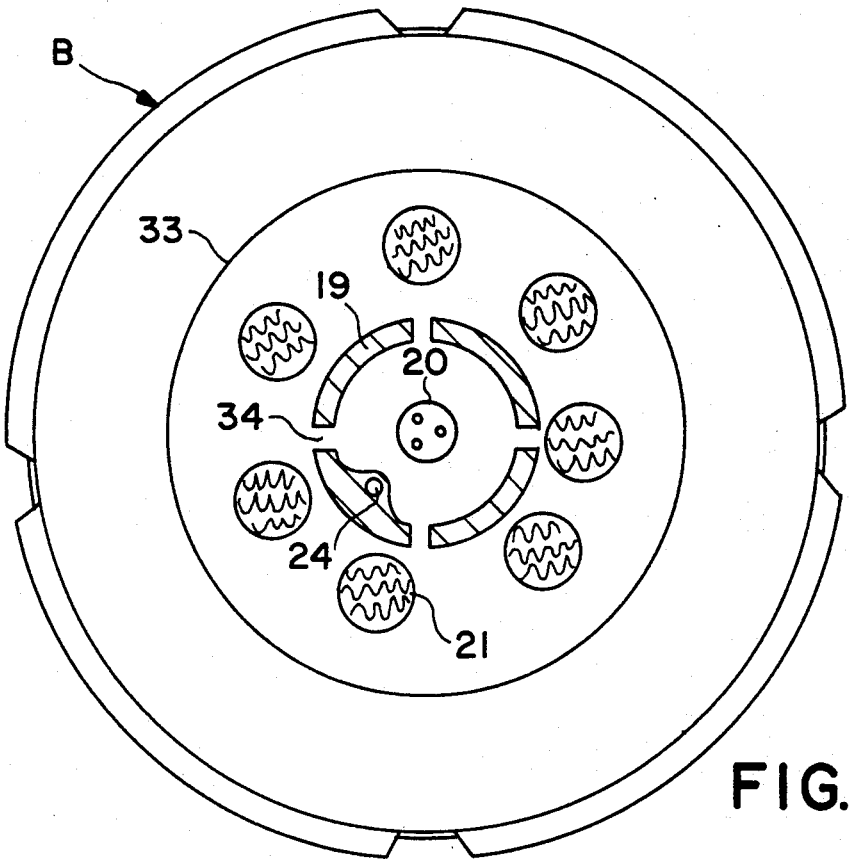
FIG. 3, a transverse section BB' of the munition represented in FIG. 1.
Figure 4:
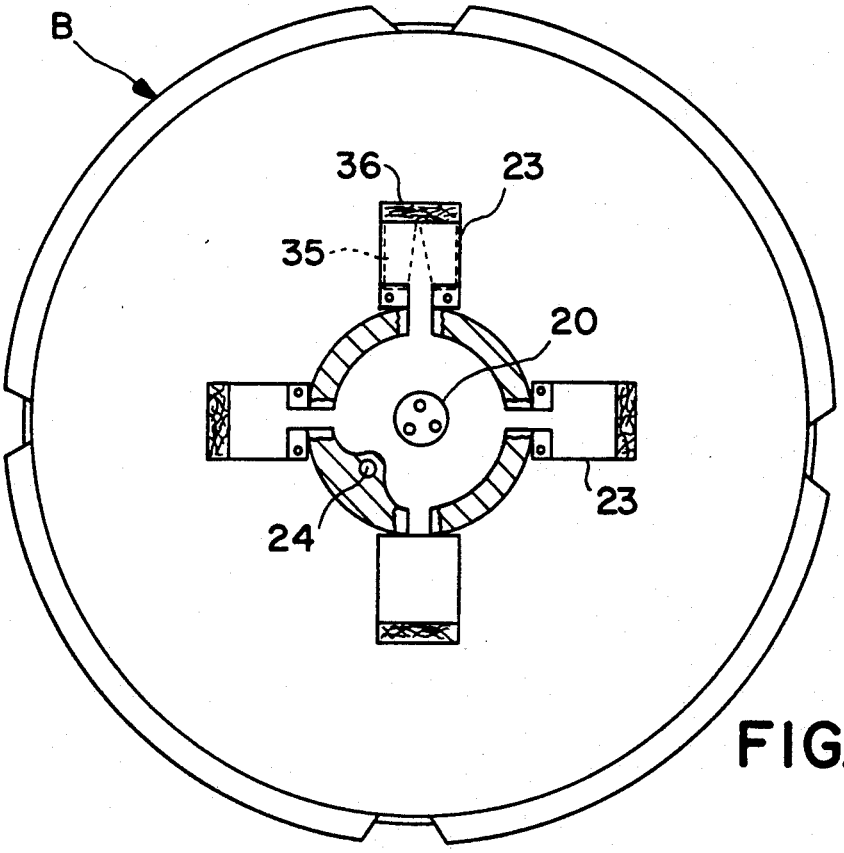
FIG. 4, a transverse section CC' of the munition represented in FIG. 1.

The reservoir B is connected, for example by a threaded joint, to the nose cone A. Its structure is made, for example, of an aluminium alloy and includes means of dislocation, for example weakened parts as shown in FIG. 2 which represents a transverse section AA' of FIG. 1. These thin parts (29) facilitate the break-up of the reservoir when a pressure generated, for example, by a powder charge placed in the reservoir is exerted inside the reservoir. The reservoir B represented in FIG. 1 comprises:

- An internal beam 8, for example, of aluminium alloy of given length having, for example, the form of the quarter of a circular tube; this beam receives rings 9, for example, screwed into holes 30 to enable the munition to be fixed under an aircraft, and support places 31, for example, of steal, reinforcing the reservoir where it is fixed under the aircraft. These are intended to bear the forces during transport. At the fixing point two safety cables emerge, a nose-cone releasable safety cable SLO and a base releasable safety cable SLC, enabling both triggering of the ignition fuze for the SLO and the locking of the parachute to the reservoir structure and the triggering of the parachute release command delay for the SLC. Each of these safety cables is operational only during release of the munition: after fixing of the munition under the aircraft, the traction of each of the cables (SLO, SLC) cannot trigger the operation of the different stages mentioned above, as each of these cables is equipped with a safety device located at the point where the cable emerges, in such a way as to prevent any movement of the cables. This safety device is equipped, for example, with a plate 32 held in closed position before fixing under the aircraft by a safety pin 11 and a ball not represented on this FIG. 1 positioned around each of the cables so as to be able to strike the plate when a tension is applied to one of the cables and thus to dislodge the plate and allow movement of the cable. When the munition is positioned under the aircraft, the safety pin 11 is removed. The plate can therefore swing on the ball fixed to the cable, but its movement is blocked by the aircraft's strut which immobilizes the plate. The slack of the cable is not sufficient to trigger one of the operations mentioned above and its action is effective only during release of the munition, when a traction is exerted on the cable. The two safety cables SLO and SLC slide in channels 10 and 12 respectively up to retracting devices 5 and 26 situated in the nose cone A and the tapered tail end C;

a filler hole 13 adapted to the means of in-flight fuelling in service in NATO;

reinforcing frames 14 some of which are designed to catch the slipstream;

an automatic level 15 enabling filling to be stopped;

a depressurization valve 16;

a pump 17 with a pressure line 18 which can be activated from the outside, for example, by an electric motor M, intended to agitate the mixture (hydrocarbon+gelatinizing liquid) to homogenize the components thanks to the swirling generated by the outlet nozzle. Under the action of the electric motor the pump outlet creates a spiral whirlpool which facilitates the mixing of the hydrocarbon and the gelatinizing agent. The use of such a pump facilitates the manipulation of the munition before it is fixed under the aircraft, by enabling the hydrocarbon to be loaded after fixing of the munition under the aircraft, while giving a mixture as good as one prepared before its insertion in the reservoir of the munition;

a pyrotechnic tube 19 which traverses the reservoir from one end to the other on its axis of symmetry XX'. It includes, first, a detonating cord 20 which enables ignition of the gas-generating grains 21 and 22 placed at the front and back of the munition and illustrated in FIG. 3 which represents a transverse section BB' of FIG. 1; these gas generators 21 generate the internal pressure ensuring break-up of the reservoir; their weight and position are optimized in order to obtain an opening in the shape of petals (weight of grains greater at the front than at the rear); these grains 21 are placed, for example, in a circular arrangement within an envelope 33 in liaison with the detonating cord 20 constituted of three parts via the holes 34 inside the pyrotechnic tube 19 enabling the transmission of the ignition orders to the various gas-generating grains. Secondly, the pyrotechnic tube includes the gel ignition capsules represented in FIG. 4 which illustrates a transverse section CC' of FIG. 1; these ignition capsules 23 are ignited by the detonating cord and are expelled from the pyrotechnic tube 19 on which they were fixed, for example by a threaded joint; the ignition capsules 23 possess means of guidance, for example, fins 35 represented by dashed lines in FIG. 4; they also contain elements of combustion 36 ignited by the detonating cord and whose duration of combustion, a few seconds, enables the mixture to be ignited during the formation of the cloud, during the fall of the particles and after scattering on the ground, if necessary. The number, size and location of these capsules 23 are defined to obtain perfect ignition of the mixture scattered after break-up of the reservoir. These capsules are made, for example, of a light alloy. Inside the pyrotechnic tube 19, as represented in FIGS. 1, 2, 3, 4 and 5 is situated a rod 24 to the back of which is attached a parachute 27; this rod 24 is connected, at the front, to the mechanism used to remove the shield 6 which interrupts the pyrotechnic ignition chain and which prevents the ignition of the pyrotechnic cord 20. The rod 24 is immobilized in the pyrotechnic tube 19 by a shear pin 39 which prevents any movement of the shield 6, to which it is connected by a lever 37, before a traction is exerted on the rod 24 after the deployment of the parachute 27; this traction enables the rod 24 to slide in the pyrotechnic tube 19 and causes the shield 6 to pivot around a point 38. At this instant the pyrotechnic chain of the fuze 40 is aligned with the detonating cord 20 and the ignition operations of the various parts can proceed normally. In FIG. 5, the shield 6 is represented in dashed lines after sliding of the rod 24. There is therefore no further obstacle to the transmission of the ignition signal when the pyrotechnic chain is initiated.

The tapered tail end C comprises:

a fixed tail-fin unit (25) fixed to the structure of the reservoir B, which is constituted for example of four fins whose span corresponds to the diagonals of a square whose side is equal to the diameter of the body of the reservoir;

a parachute 27 contained in a cup 41 connected to the structure of the reservoir B by a device for locking and release of the parachute which is initialized by sufficient traction on the base releasable safety cable SLC;

a device to retract the SLC 26 which, after shearing of the pin holding the SLC to the aircraft thanks to a sufficient traction force, enables any part of the SLC not flush with the outside of the munition, which could disturb the operations, to be retracted.

These various major parts are assembled in a simple way, for example by a threaded joint, to facilitate inspection and if necessary replacement of certain parts during specific controls Having described the munition, we shall now explain its operation. After having taken care to fill the munition with the mixture before or after the munition is fixed, as described above, and after fixing of the munition to the aircraft, the rings of the releasable safety cables SLO and SLC are simply fixed to the corresponding devices of the aircraft and the safety pins 11 are removed to make the munition ready for operation. When the munition is released, the plates 32 pivot and the SLO and SLC cables are placed under traction. The munition separates from the aircraft. The SLO unlocks the turbo-alternator and the rotating fuze support. The rotation of the fuze enables a proximity measurement which is independent of the roll of the reservoir. The turbo-alternator supplies power to the proximity detector which does not yet detect the ground. The safety device coupled to the turbo-alternator begins to turn the barrel which assures pyrotechnical chain disalignment. Meanwhile the SLC enables the parachute to be unlocked to the munition structure and triggers the parachute release command delay. At the end of the delay, the parachute is deployed; this brakes the munition to distance it from the aircraft. When the force supplied by the parachute is sufficient, it pulls the rod 24. The rod shears its pin 39 and slides in the pyrotechnic tube and, in front, displaces the shield 6 which interrupted the pyrotechnic chain at the back of the fuze. A few seconds after the release of the munition, the safing device finishes moving the barrel of the fuze and the pyrotechnic chain becomes aligned. At a height of a few meters, for example, the proximity module detects the ground and triggers the ignition of the pyrotechnic chain. The detonating cord for transmission of ignition burns inside the pyrotechnic tube and, after a few milliseconds, initiates the gas-generating grains and the gel ignition capsules. The pressure generated by the gas generation breaks up the munition. The mixture is subjected to aerodynamic pressure which disperses it in small drops. The burning ignition capsules are expelled in this cloud and pursue their trajectory to the ground where they continue to burn for several seconds. The small drops of the mixture burn continuously during their fall and after scattering on the ground. If by any chance the proximity module should fail, a backup device incorporated in the fuze initiates the pyrotechnic chain on impact on the ground.

On release without traction of the safety cables SLO and SLC, the fuze is not activated, the pyrotechnic chain is disaligned (barrel) and interrupted (shield). Moreover, the parachute is not locked to the structure and it is not liberated.

The munition according to the invention applies particularly to releasable charges intended to have an incendiary effect on various targets on the ground but it can be applied for uniform scattering of any product in a determined location.

What is claimed is:

1. Munition comprising a reservoir inside which is placed an incendiary mixture of hydrocarbons and gelatinizing agents; means of distribution triggered before the munition hits the ground to provoke regular scattering of the incendiary mixture on the ground; and means of igniting the mixture in order to cause an important incendiary effect on the various targets on the ground; the means of distribution of the mixture comprises a detonating cord placed inside a pyrotechnic tube positioned along a longitudinal axis XX' of the munition, and gas-generating grains placed around the pyrotechnic tube; a shield placed between an exit of a fuze and the detonating cord to interrupt the pyrotechnic chain; and a rod fixed to the shield by a lever to move the shield.

2. Munition according to claim 1, wherein the rod (24) slides within the pyrotechnic tube (19), under the action of a braking parachute (27) placed at the rear of the munition.

3. Munition according to claim 2, comprising a pin locking the rod wherein the sliding of the rod is made possible by the shearing of the pin under the action of the deployment of the parachute.

4. Munition according to claim 1, wherein the means of ignition of the mixture are pyrotechnic ignition capsules positioned around the pyrotechnic tube containing the detonating cord.

5. Munition according to claim 4, wherein the ignition capsules are formed of tubes equipped with small fins to increase their stability.

6. Munition according to claim 1, wherein the fuze contained inside a nose cone comprises a proximity detector to trigger the means of distribution of the munition and its means of ignition before impact on the ground.

7. Munition according to claim 1 comprising a releasable nose cone safety cable means and a releasable base safety cable means for enabling the means of distribution and ignition to be triggered only after traction to both of these two safety cable means.

8. Munition according to claim 1, wherein the reservoir comprises means of dislocation, to break up said reservoir of the munition.

9. Munition comprising a reservoir inside which is placed an incendiary mixture of hydrocarbons and gelatinizing agents; means of distribution triggered before the munition hits the ground to provoke regular scattering of the incendiary mixture on the ground; and means of igniting the mixture in order to cause an important incendiary effect on the various targets on the ground; means for fixing the munition under an aircraft, a pump positioned inside the reservoir to make the mixture after the hydrocarbon is added which is after fixing of the munition under the aircraft by the fixing means.

10. Munition according to claim 9, wherein the pump is activated by an electric motor placed outside the munition to enable the mixture to be homogenized.

11. Munition comprising along a longitudinal axis XX' a front part (A) and a rear part (C) attached to a central part (B), said central part having a reservoir and an external envelope, the reservoir being designed to be filled with an incendiary mixture, said reservoir comprising a detonating cord (20) positioned along the axis XX'; the detonating cord, upon firing of an initiating device (3), propagating a detonation wave; and positioning means for positioning, within said reservoir, a plurality of gas generating grains, circumferentially at various longitudinal places around the detonating cord and also for positioning, within said reservoir, a plurality of expellable ignition capsules (23), circumferentially at various longitudinal places around the detonating cord; the gas generating grains (21, 22) scattering the incendiary mixture, and the ignition capsules igniting the incendiary mixture while and after scattering.

12. Munition according to claim 11, wherein the positioning means comprises a tube (19) having an inside and an outside part and transversal holes in between, the tube being provided with fixing means to position the gas generating grains (21, 22) and the expellable ignition capsules (23) circumferentially at the outside part of the tube, in a place where they can receive through the transversal holes the detonation wave from the detonating cord (20), the detonating cord being disposed longitudinally in the inside part of the tube (19).

13. Munition according to claim 12 further comprising two different safety devices, a first one and a second one.

14. Munition according to claim 13 where the first safety device comprises a propeller rotationally attached to the front part (A), a retracting device having two positions, a first one where it prevents the propeller to rotate and a second one where it does not, and a first cable having two ends, a first and a second one, the first end being attached to the retracting device, the second end going outside the munition.

15. Munition according to claim 14, where the second safety device comprises a parachute having two positions, a first one when it is closed inside the rear part (C) of the munition, a second one spread outside the rear part, a cable to release the parachute to go from the first to the second position, a shield (6) having two positions, a first one where it prevents any detonating wave coming from the initiating device to reach the detonating cord (2) and a second one where it does not, a rod (24) having two ends, a forward one attached to the shield (6) and a rear one attached to the parachute (27), the rod being slidably moveable to move the shield from the first to the second position when the parachute goes from the first to second position.

16. A munition according to claim 12, wherein said ignition capsules are formed of tubes equipped with small fins to increase their stability.

17. Munition according to claim 11 further comprising two different safety devices, a first one and a second one.

18. Munition according to claim 17 where the first safety device comprises a propeller rotationally attached to the front part (A), a retracting device having two positions, a first one where it prevents the propeller to rotate and a second one where it does not, and a first cable having two ends, a first and a second one, the first end being attached to the retracting device, the second end going outside the munition.

19. Munition according to claim 18, where the second safety device comprises a parachute (27) having two positions, a first one when it is closed inside the rear part (C) of the munition, a second one spread outside the rear part, a cable to release the parachute to go from the first to the second position, a shield (6) having two positions, a first one where it prevents any detonating wave coming from the initiating device to reach the detonating cord (2) and a second one where it does not, a rod (24) having two ends, a forward one attached to the shield (6) and a rear one attached to the parachute (27), the rod being slidably moveable to move the shield from the first to the second position when the parachute goes from the first to second position.

20. A munition according to claim 11, further comprising a proximity fuse which initiates firing.

21. A munition according to claim 11, further comprising means for fixing said munition under an aircraft, a pump position inside the reservoir to make the mixture after the hydrocarbon is added, which is after fixing the munition under the aircraft by the fixing means.

* * * * *